US006347495B1

(12) United States Patent
Conterno

(10) Patent No.: US 6,347,495 B1
(45) Date of Patent: Feb. 19, 2002

(54) PANEL COUPLING ASSEMBLIES

(75) Inventor: Cosimo Conterno, Mendrisio (CH)

(73) Assignee: Politec Polimeri Tecnici S.A., Stabio (CH)

( * ) Notice: Subject to any disclaimer, the term of this patent is extended or adjusted under 35 U.S.C. 154(b) by 0 days.

(21) Appl. No.: 09/265,796

(22) Filed: Mar. 10, 1999

(30) Foreign Application Priority Data

Mar. 12, 1998 (CH) ..... 0597/98
May 18, 1998 (GB) ..... 9810459

(51) Int. Cl.[7] ..... F04B 2/30

(52) U.S. Cl. ..... 52/483.1; 52/235; 52/243; 52/506.1; 52/508; 52/511; 52/733.4; 248/223.4; 403/396; 403/363

(58) Field of Search ..... 52/235, 243, 474, 52/482, 506.05, 506.06, 506.09, 506.1, 508, 511, 460, 271, 464, 563, 588.1, 762, 770–775, 779, 760, 733.4, 483.1, 580, 586.1, 582.1, 36.5, 36.6; 403/363, 292, 294, 335, 396; 248/223.4, 225.1

(56) References Cited

U.S. PATENT DOCUMENTS 3,568,391 A 3/1971 Conway
5,412,912 A 5/1995 Alves ..... 52/36.5
5,580,620 A 12/1996 Campbell et al. ..... 428/34
5,901,528 A * 5/1999 Richardson ..... 52/783.1
6,112,493 A * 9/2000 Rickman ..... 52/646

FOREIGN PATENT DOCUMENTS

| | | |
|---|---|---|
| EP | 0816585 A2 | 1/1998 |
| EP | 0835968 A2 | 4/1998 |
| EP | 0864708 A2 | 9/1998 |
| FR | 2525674 | 10/1983 |
| GB | 2212183 A | 7/1989 |
| GB | 2291456 A | 1/1996 |

* cited by examiner

*Primary Examiner*—Carl D. Friedman
*Assistant Examiner*—Yvonne M. Horton
(74) *Attorney, Agent, or Firm*—Jacobson Holman, PLLC

(57) ABSTRACT

Two generally co-planar panels (4) are supported almost edge-to-edge by an intermediate beam (1). A coupling member (2) is captive to the beam (1) by interengaging longitudinal formations (6,11) and provides an interlocking engagement (12,18) for the edges of the panels (4). Opposite the coupling member (2) the beam (1) is proud of the panels (4) and receives and retains a cap (3) which seals against the panels (4). An assembly for attaching such beams and panels to a wall (30) to project therefrom is described.

2 Claims, 7 Drawing Sheets

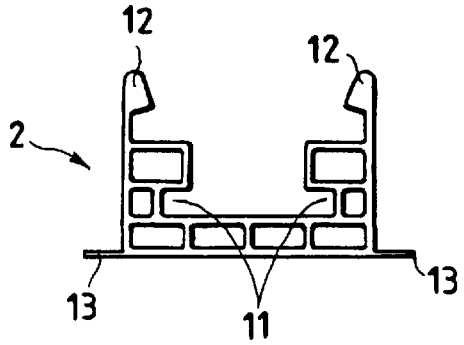
Fig.3
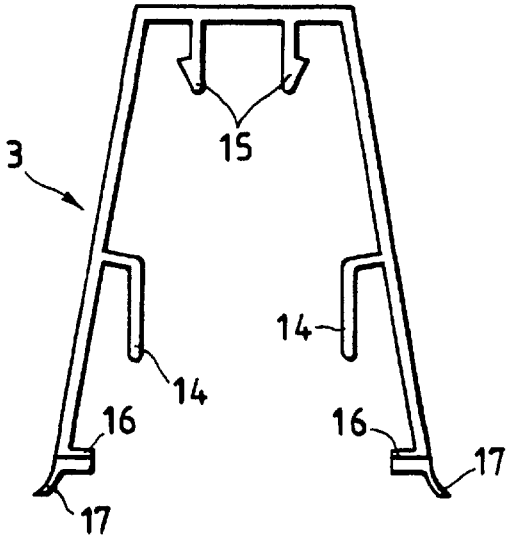
Fig.4
Fig.5
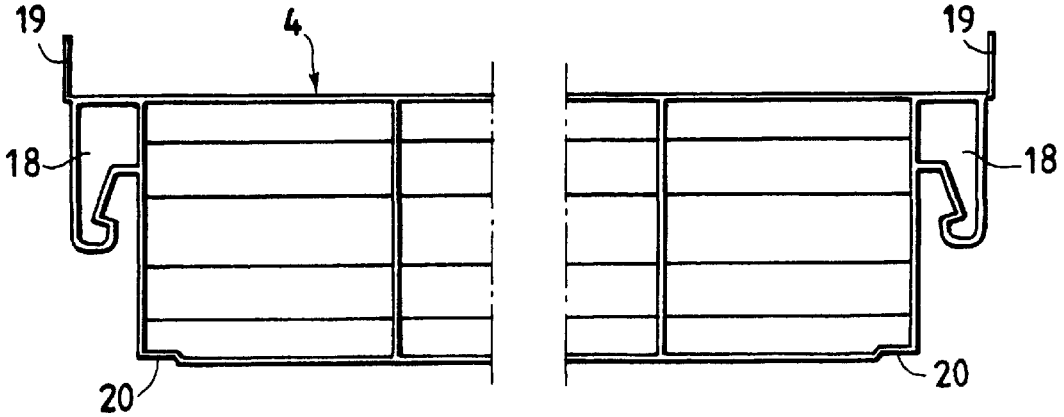

PANEL COUPLING ASSEMBLIES

BACKGROUND OF THE INVENTION

Field of the Invention

This invention relates to panel coupling assemblies. It is particularly concerned with roofs, such as those of conservatories, having transparent or translucent panels supported side by side by beams. These beams are generally part of the framework of the structure.

There are various requirements for such assemblies, and in particular the panels must be held securely and the joints must be waterproof. There should also be high degrees of thermal and acoustic insulation. At the same time assembly should be simple and preferably be achievable by one person working alone. Where such roofs spring from a wall, the attachment to the wall should also be simple secure and weatherproof.

SUMMARY OF THE INVENTION

According to one aspect of the present invention there is provided a coupling assembly for two substantially co-planar panels, the assembly comprising a beam, a coupling member and a cap, the coupling member being engageable with a first longitudinal portion of the beam to be retained thereby, the adjacent edges of the panels having formations engageable with the coupling member to be retained thereby on opposite sides of the beam, and the cap being engageable with a second longitudinal portion of the beam, proud of the panels, to cover said second portion and the edge formations.

The first longitudinal portion of the beam conveniently has lateral flanges or ribs which engage in complementary grooves of the coupling member, while the edge formations of the panels preferably interhook with edge portions of that member. The coupling member may thus be channel shaped with the grooves at the base of the channel terminating in hooked edge formations.

Preferably, the interhooking of the panel edge portions with the coupling member is by snap action.

In a roof structure, the first longitudinal portion of the beam will be underneath, but it will be concealed from view below by the coupling member, which can provide the insulation referred to above.

Generally, sealing means will be interposed between the panels and the edges of the cap that co-operate with the panels. These may comprise interengaging formations on the cap and panels enabling the cap to be fitted and removed only by being slid longitudinally.

Both the panels and the coupling member are preferably multiwall extrusions of synthetic resin such as polycarbonate. The cap may be an extrusion of solid resin, such as PVC, while the beam will normally be of metal, such as an aluminum extrusion.

According to another aspect of the invention there is provided an assembly for attaching beams and panels supported thereby to a wall to extend generally perpendicularly therefrom, the assembly comprising a bracket for securing to the wall, a main support member that attaches to the bracket and provides a shelf on which the ends of the beams and panels bear, infill elements that fit to the support member above the panels and between the beams to bear on the panels, a weather strip attached to the support member to lie along the wall and cover the assembly, and a soffit attached to the support member to lie along the wall and shield the underside of the assembly.

The main support member may have a flange above the shelf, the ends of the beams and the panels being overhung by this flange. The beam assembly comprising the beam, coupling member and cap will preferably be a close fit between the shelf and the overhanging flange.

BRIEF DESCRIPTION OF THE DRAWINGS

For a better understanding of the invention some embodiments will now be described, by way of example, with reference to the accompanying drawings, in which:

FIG. 3 is a cross-section of a coupling member, FIG. 4 is a cross-section of a cap, FIG. 5 is a fragmentary cross-section of a panel.

DESCRIPTION OF THE INVENTION

Figure 1:
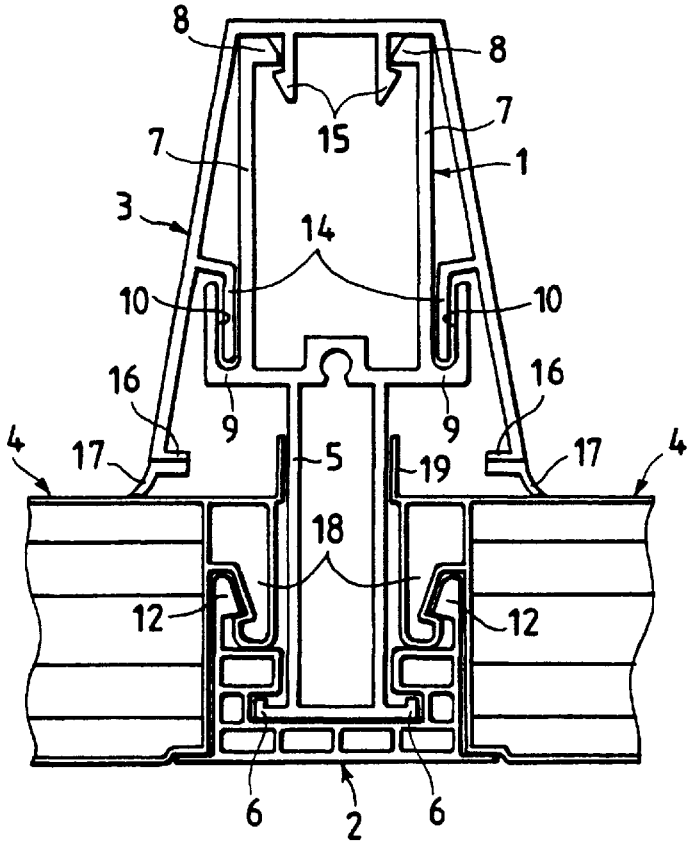
FIG. 1 is a cross-section of part of a roof with two panels carried by a support beam assembly.
Figure 2:
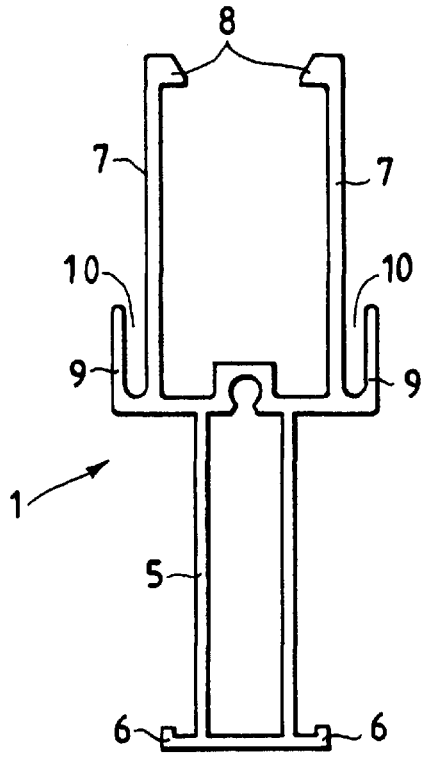
FIG. 2 is a cross-section of a support beam.

The support assembly comprises a beam 1, a coupling member 2 and a cap 3, and it carries panels 4 symmetrically on opposite sides.

The beam 1 is conveniently an aluminum extrusion, symmetrical with respect to a central vertical plane, and having a slim box section 5 with its larger walls vertical forming a lower half. Along the base of this there are upwardly hooked flanges 6 projecting at each side. The upper half of the extrusion comprises upstanding limbs 7 stepped outwardly from the top of the box section 5 and with inwardly projecting ribs 8 along their top edges, while beyond the base of each limb 7 there are further outward and upturned flanges 9 forming narrow channels 10 at each side.

The coupling member 2 is another extrusion, but preferably of polycarbonate, with a multitude of box sections to make its main body stiff. This main body is generally channel-shaped, but within and at the base of the channel there are undercut grooves 11 along each side. At the top of each limb of the main body there are inwardly hooked flanges 12 and on the exterior at the edges of the base, there are outwardly projecting thin plain flanges 13.

The cap 3 is a further extrusion, conveniently of PVC or polycarbonate. It is of inverted channel shape, its side limbs splaying outwardly from the flat top. Internally, at about their mid-height, these side limbs have wings 14 projecting a short distance inwardly and then downwards, while underneath the flat top there are downwardly projecting barbs 15. Along the lower edges of the side limbs there are narrow inturned flanges 16 against which engage sealing strips 17 extending along closely inside the edges of the panels 4. Instead of being adhered to the panels these sealing strips 17 could be attached to the flanges 16 as shown in FIG. 4 and bear on the panels when the cap 3 is fitted.

Figure 6:
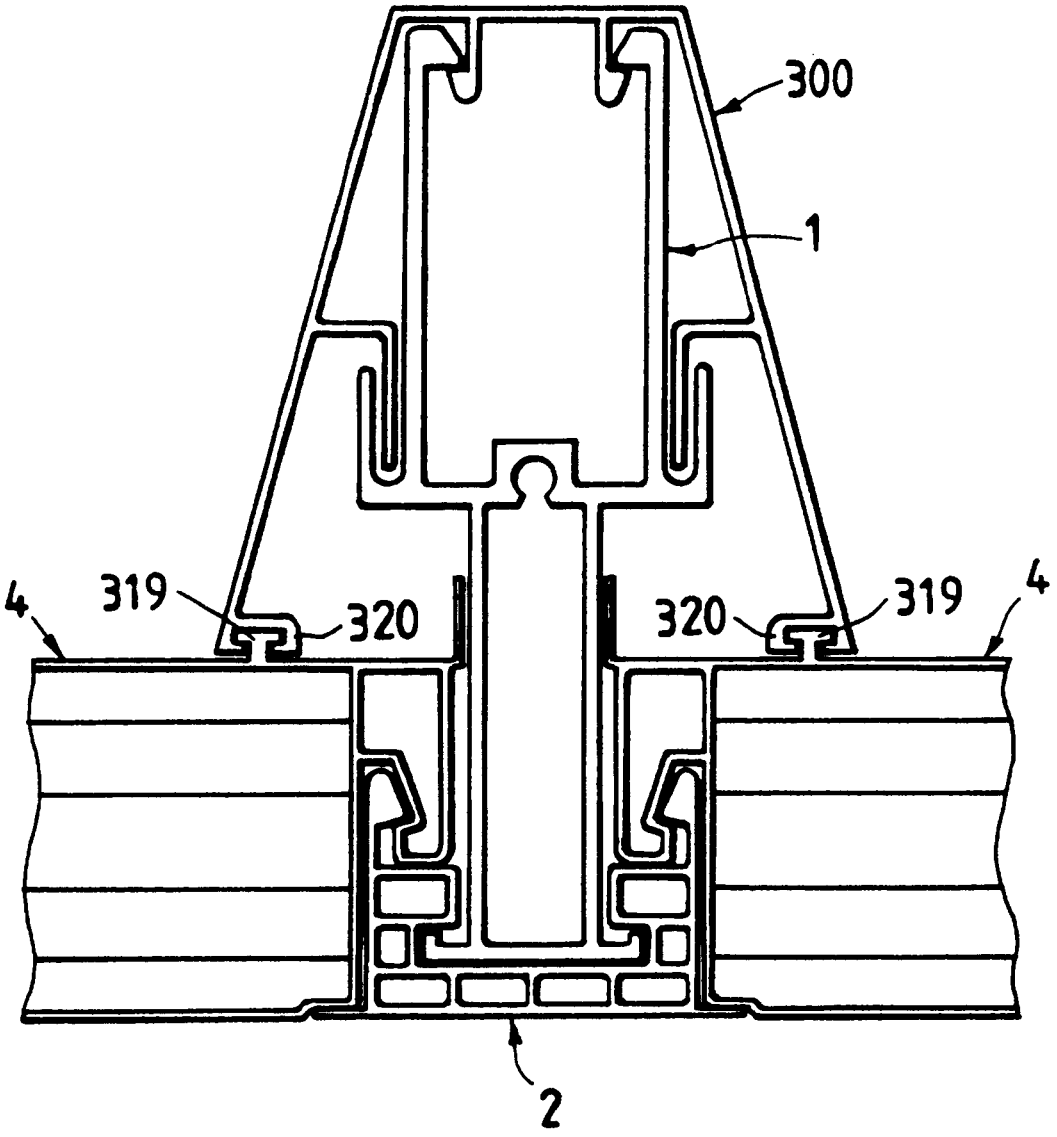
FIG. 6 is a cross-section of another embodiment of the support beam assembly, in which the sides of the covering cap and the edge portions of the panels have complementary profiles.

An alternative cap 300 with a different sealing arrangement is shown in FIG. 6 where the panels 4 have T-section rails 319 integrally formed on their upper surfaces parallel to and a short distance away from their longitudinal edge. Instead of the plain flanges 16, there are grooved flanges 320 at the lower edges of the side limbs of the cap, complementary to the rails 319. These serve both as guides during assembly (the cap cannot be snapped on in this embodiment) and as virtually impermeable barriers against ingress of water. The panels 4 are also extrusions, preferably of polycarbonate, and they will generally be multi-walled and multi-layered. At their opposite edges which are to co-operate with respective support assemblies, each panel has downwardly and then inwardly hooked formations 21. The top of the panel continues flush with the backs of these hooks, and where they turn down there are upright flanges 22. The underside of each panel is indented at 23 along each edge below a hooked formation 21.

The assembly is put together by first sliding the coupling member 2 onto the beam 1, the flanges 6 entering the grooves 11. The beam 1 will then be secured in place, with others in parallel. The panels 4 are then lowered and pressed into place, their hooked formations 21 snapping past the hooked flanges 12. Simultaneously, the flanges 13 seat in the indentations 23. The cap 3 of FIG. 4 (if used) is then placed over the beam 1 and urged down. The wings 14 locate in the channels 10 formed by the flanges 9 as the barbs 15 snap past the ribs 8. At the same time, the sealing strips 17 engage. Should any water lying on the panels 4 get past those seals, the flanges 19 will prevent ingress into the coupling member 2.

If the cap of FIG. 6 is used, with the appropriate panels, it is slid longitudinally into position.

Instead of pressing the panels into place, it may be preferred to slide them perpendicularly to the plane of FIG. 1.

While certain materials have been suggested above as appropriate, it will be understood that alternatives could be used. But it is advantageous to have the coupling member 2 and the panels 4 of the same material with the same coefficient of thermal expansion and with good thermal insulating properties. They need not have the same translucency and color, however, and the panels 4 may be transparent and colorless for example, while the coupling member 2, whose underside is visible, may be opaque and colored.

The beam 1 will be the main load bearer and to keep its dimension within bounds it will probably need to be of metal, conveniently an aluminum extrusion. It will therefore conduct heat more readily than the plastics materials of the other elements. But it is completely separated by the coupling member 2 from the space below and will not be the cause of any excessive heat loss.

Referring now to FIGS. 7 to 12, these show a general arrangement and individual component for supportively attaching a panel and beam assembly as described above to a vertical wall 30, the beam 1 extending perpendicularly to the wall.

First, a bracket 31 is secured horizontally to the wall. This is a strip of cranked cross-section so that its upper portion 32 stands away from the wall while fasteners, such as screws, hold its lower portion 33 against the wall.

A main support member 34 hooks on to this bracket. It is quite a complex extrusion, but it is generally of U-section, on its side and with a flange 35 extending down from the lower corner. The web 36 of the U is cranked in cross-section into the bight of the U and has a downwardly projecting tongue 37 at the top of the cranked section that hooks behind the upper portion 32 of the bracket 31, while the flange 35 and the lowermost portion of the web 36 bears against the lower portion 33 of the bracket. The member 34 can be secured by fasteners through the flange 35. Immediately above the tongue 37, on the shoulder on the other side of the web 36, there is an upstanding rib 38 forming a longitudinal groove with the web.

The horizontal lower flange 39 of the member 34 provides a shelf or ledge on which rest the ends of the panels 4 and the coupling member 2, the latter being secured by a screw up through the flange 39. On the underside of this flange there are longitudinal ribs 40 forming two parallel grooves, one adjacent the flange 35.

The upper flange 41 (thinner than the lower one) of the member 34 has a short upward crank near its root and terminates at its edge in an upstanding rib 42 of inverted U-form, the outer limb inclining outwardly and downwardly.

This flange has longitudinal ribs 43 on its upper side forming parallel grooves, one at the corner and the other flanked by the rib 42.

The spacing of the flanges 39 and 41 is such that the support beam assembly 1, 2, with its cap 3 is a close-fit between them.

Figure 9:
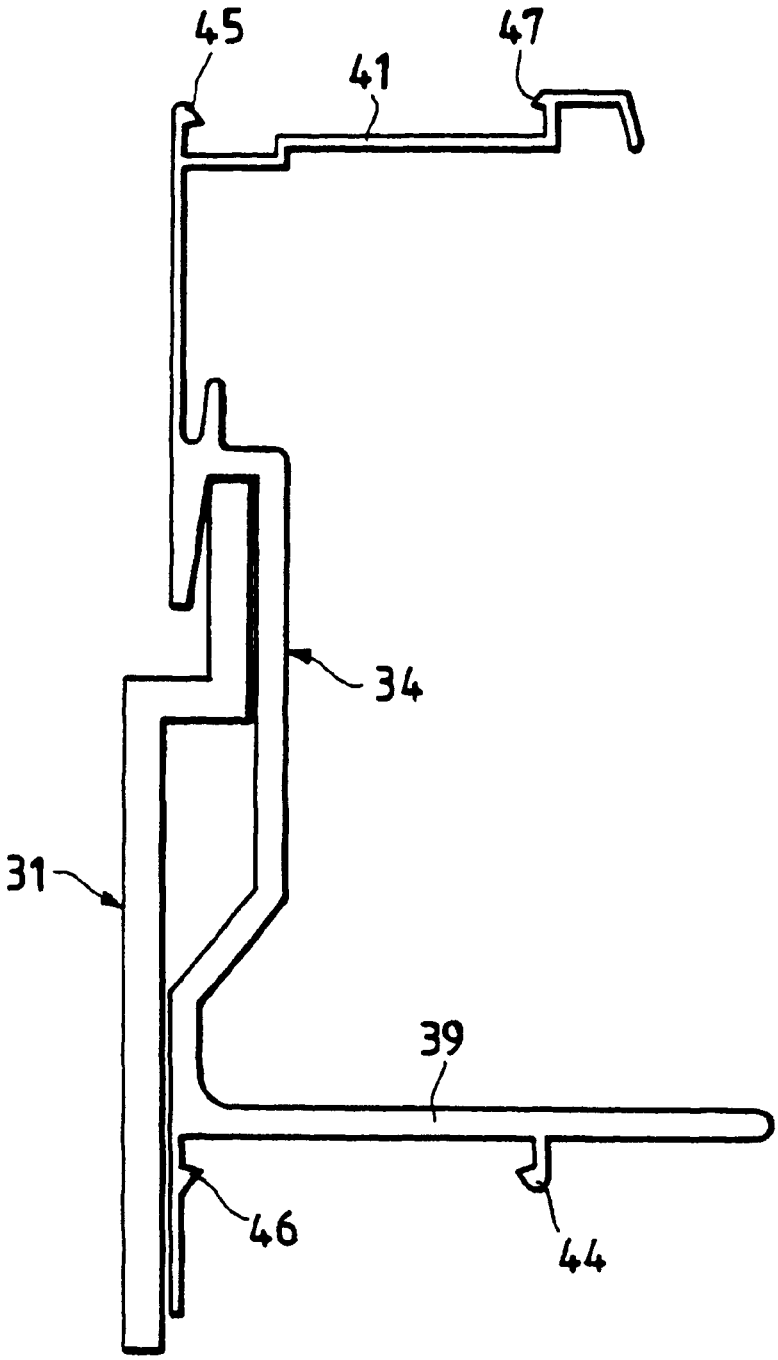
FIG. 9 is a cross-section of a retainer forming part of the assembly of FIG. 7.
Figure 10:
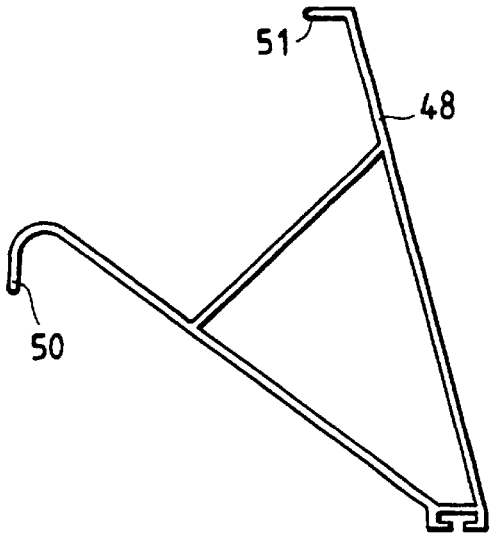
FIG. 10 is a cross-section of a shaped element connecting a support member and the panels.

A minor variation is shown in FIG. 9, where instead of ribs 40 and 43 forming grooves, there are single barbed ribs 44 and 45 replacing two pairs of ribs, and the flange 35 and the rib 42 have linear projections 46 and 47 of tooth-like cross-section, with no adjacent ribs.

Figure 7:
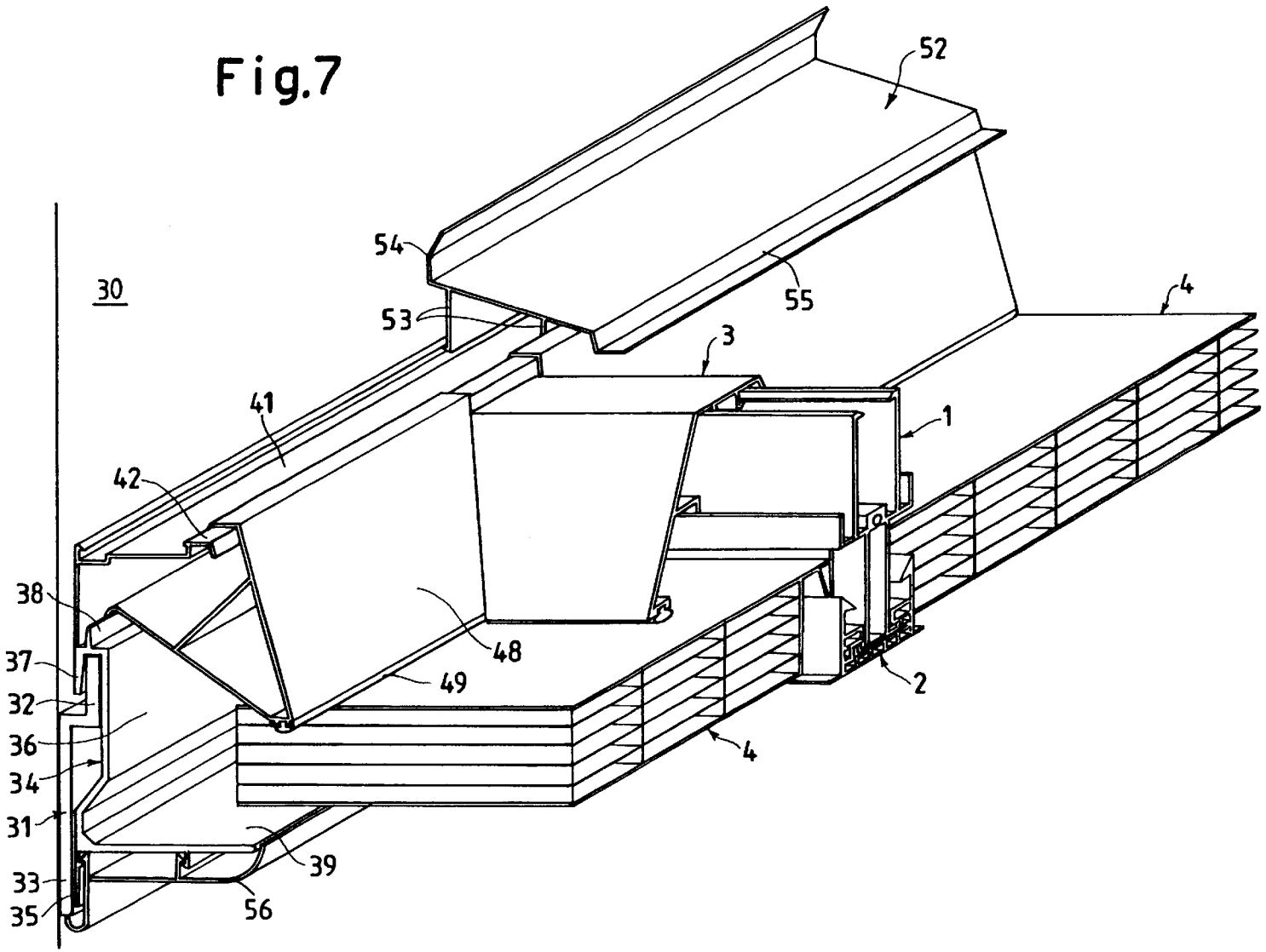
FIG. 7 is a perspective view, partially in cross-section, of an assembly for supportively connecting the support beam and panels to a wall.

An infill element 48 to cover the gaps below the flange 41 is a generally A-section extrusion. At its apex it is formed with a groove to receive a sealing strip 49, while the ends of its legs have feet 50 and 51 both bent in the same direction, but one rather more than the other. The more acutely bent foot 50 hooks into the groove behind the rib 38, the other hook co-operates closely with the upper and outer sides of the rib 42, while the sealing strip 49 bears on the top of the associated panel 4. The ends of the element are angled to bear closely against the flanks of the caps 3, as best seen in FIG. 7.

An extruded weather strip 52 is then fitted. It is generally π-shaped in cross section but with the transverse portion sloping down from the wall and shaped at the edges.

Figure 8:
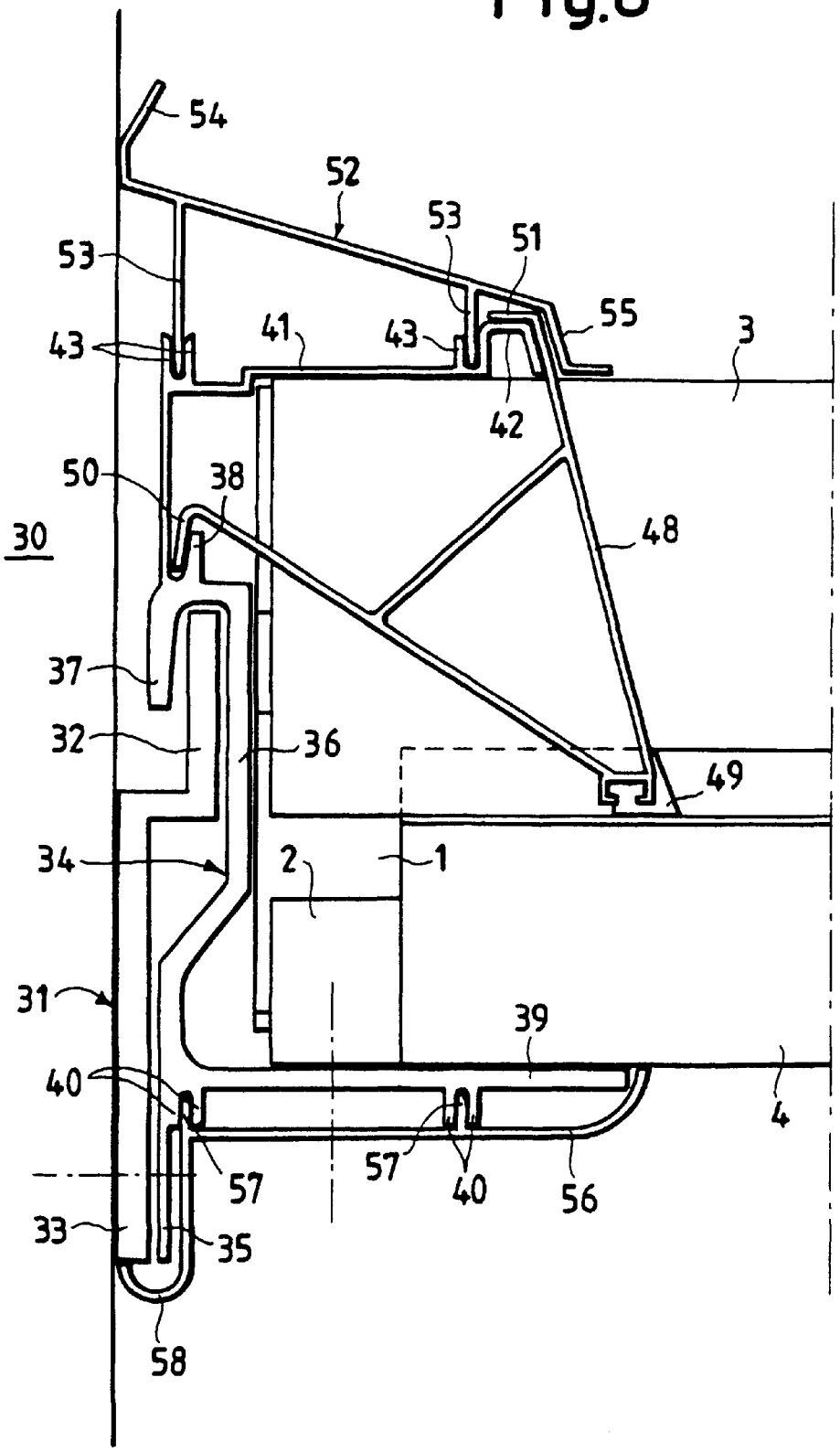
FIG. 8 is a vertical cross-section of part of the assembly of FIG. 7.

The bottom edges of the vertical legs 53 in FIG. 8 press fit into the grooves formed by the ribs 43, the bent-up upper edge 54 of the transverse portion bears against the wall 30, and the cranked down lower edge 55 of the transverse portion overlies the foot 51 and adjacent part of the leg of the retainer 48, terminating level with the extremity of the rib 43 so that it does not interfere with the cap.

An extruded soffit 56 provides a neat finish underneath. This is generally L-shaped in cross-section, with ribs 57 on the longer limb to engage in the grooves formed by the ribs 40. It has curved edges to shield the free edges of the flanges 35 and 39, the curved edge 58 of the shorter limb turning back to engage the underside of the lower portion 33 of the bracket 31.

Figure 11:
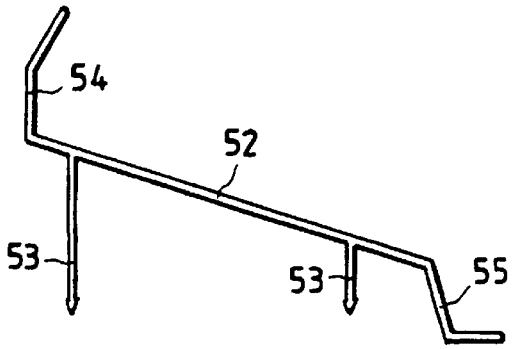
FIG. 11 is a cross-section of a cover strip forming part of the assembly of FIG. 7.
Figure 12:
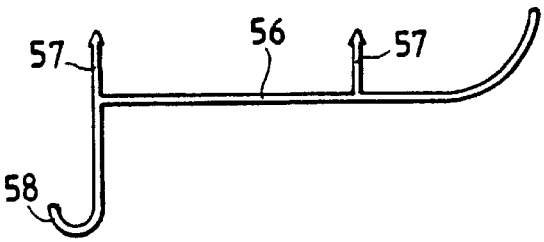
FIG. 12 is a cross-section of a soffit forming part of the assembly of FIG. 7.

When the member 34 of FIG. 9 is used, the weather strip and soffit will be modified as shown in FIGS. 11 and 12, with barbs to snap past the barbed ribs 44 and 45 and the projections 46 and 47. It will be understood that in the embodiment of FIG. 8 there could also be a positive snap fit in the grooves, rather than just a press fit. Alternatively, the strip 52 and the soffit 56 could have dovetail formations for sliding into complementary grooves in the member 34.

What is claimed is:

1. An assembly for attaching beams having ends and panels supported thereby to a wall and extending generally perpendicularly therefrom, the assembly comprising:

a bracket for securing the panels horizontally to the wall, said bracket having an upper portion positioned away from the wall and a lower portion positioned against the wall;

a generally U-shaped main support member having a flange projecting downwardly and bearing against the lower portion of the bracket, and a tongue protruding around said upper portion of the bracket and positioned between the wall and the bracket;

a shelf formed by said main support member and extending perpendicularly from said wall for bearing the ends of the beams and panels;

A-shaped infill elements having legs for hooking to the support member above the panels and an apex for bearing on the panels, each said infill element positioned between the beams;

a weather strip attached to the support member and lying along the wall, said weather strip for covering the assembly, and a soffit attached to the support member and lying along the wall, said soffit for shielding the underside of the assembly.

2. The assembly as claimed in claim 1, wherein the main support member has a flange positioned above the shelf, and the ends of the beams and the panels being overhung by said flange.

* * * * *